US007971856B2

(12) United States Patent
Kochan

(10) Patent No.: US 7,971,856 B2
(45) Date of Patent: Jul. 5, 2011

(54) DRIVE ROPE AND DRIVE PULLEY

(75) Inventor: Stephen J. Kochan, Skaneateles, NY (US)

(73) Assignee: J.R. Clancy, Inc., Syracuse, NY (US)

( * ) Notice: Subject to any disclaimer, the term of this patent is extended or adjusted under 35 U.S.C. 154(b) by 1217 days.

(21) Appl. No.: 11/564,312

(22) Filed: Nov. 29, 2006

(65) Prior Publication Data

US 2008/0121854 A1 May 29, 2008

(51) Int. Cl.
*B66D 1/30* (2006.01)

(52) U.S. Cl. ..... 254/372; 254/371; 254/393; 187/254; 474/177; 474/190; D8/360

(58) Field of Classification Search ..... 254/393, 254/372, 371, 373, 374; 187/254; 474/169, 474/174, 177, 190; D8/360
See application file for complete search history.

(56) References Cited

U.S. PATENT DOCUMENTS

| | | | | |
|---|---|---|---|---|
| 3,279,762 | A * | 10/1966 | Bruns | 254/266 |
| 3,391,531 | A | 7/1968 | Riggs | |
| 3,619,317 | A | 11/1971 | Shulver et al. | |
| 3,797,806 | A * | 3/1974 | Demmert | 43/8 |
| 4,151,980 | A * | 5/1979 | Burton et al. | 254/371 |
| 4,287,651 | A * | 9/1981 | Cilderman et al. | 29/892.1 |
| 4,402,488 | A * | 9/1983 | Berkovitz | 254/371 |
| 4,603,839 | A * | 8/1986 | Ekman et al. | 254/329 |
| 5,112,933 | A * | 5/1992 | O'Donnell et al. | 528/61 |
| 5,378,206 | A | 1/1995 | Mizuno et al. | |
| 5,429,339 | A | 7/1995 | Sugiyama | |
| 5,792,294 | A * | 8/1998 | Randazzo et al. | 156/94 |
| 5,947,451 | A * | 9/1999 | Cavanagh | 254/374 |
| 6,070,858 | A | 6/2000 | Hase et al. | |
| 6,318,504 | B1 * | 11/2001 | De Angelis | 187/254 |
| 6,358,609 | B2 | 3/2002 | Kinoshita et al. | |
| 6,364,061 | B2 * | 4/2002 | Baranda et al. | 187/254 |
| 6,371,448 | B1 | 4/2002 | De Angelis | |
| 6,397,574 | B1 | 6/2002 | De Angelis | |
| 6,468,656 | B1 | 10/2002 | Beha | |
| 6,563,054 | B1 | 5/2003 | Damien et al. | |
| 6,866,922 | B2 | 3/2005 | Takehara et al. | |

FOREIGN PATENT DOCUMENTS

| | | | |
|---|---|---|---|
| EP | 1431450 | A2 | 6/2004 |
| WO | WO 2004/076327 | A1 | 9/2004 |

* cited by examiner

*Primary Examiner* — Emmanuel M Marcelo
(74) *Attorney, Agent, or Firm* — George R. McGuire; David B. Woycechowsky; Bond Schoeneck & King

(57) ABSTRACT

The present invention discloses a drive system for theatrical rigging, comprising a drive rope and a drive pulley. The drive rope has a fiber or cable core, surrounded by a plastic jacket. Formed on or in the surface of the drive rope are traction features that engage corresponding grooves in the drive pulley.

4 Claims, 2 Drawing Sheets

DRIVE ROPE AND DRIVE PULLEY

BACKGROUND OF THE INVENTION

The present invention relates to a cable or rope for use in drive lines of theatrical rigging systems.

SUMMARY OF THE INVENTION

In power assisted counterweight theatrical rigging systems, it is preferable to use loft blocks and head blocks of the same size as in a manual counterweight rigging system. According to one power assisted counterweight rigging system disclosed in pending U.S. patent application Ser. No. 11/532,975, which is assigned to the assignee of this application, the drive line of the system is comprised of a combination of drive chain and rope or cable. In such a system, the drive chain is used to ensure that the rotary motion of the drive motor is efficiently transmitted to the drive line. Operation of the chain drive in such a system can produce extraneous noise, which is undesirable in a theatrical environment. In addition, the chains used in chain drive systems are heavier than rope of a comparable length and the combination of chain and rope drive in the drive line requires rope-to-chain transition connectors.

It is therefore a principal object and advantage of the present invention to provide an efficient drive system for a power assisted counterweight rigging system that does not involve the extraneous noise associated with chain drive mechanisms. It is a further objective of the present invention to provide a drive line that is lighter than a chain-rope combination and has no requirement for rope-to-chain connectors.

In accordance with the foregoing objects and advantages, the present invention provides a flexible drive rope comprising a core of natural fiber, synthetic fiber, or metallic material. The core is surrounded by a layer of flexible material that includes traction features. Also disclosed is a drive pulley that contains traction features that correspond to the traction features of the drive rope. Accordingly, the drive rope and drive pulley co-operate to provide an efficient, but generally quiet drive system that can be connected to a variety of drive motors and used with counterweight rigging systems that have been retrofitted to use a motor.

BRIEF DESCRIPTION OF THE DRAWINGS

The present invention will be more fully understood and appreciated by reading the following Detailed Description in conjunction with the accompanying drawings, in which.

DETAILED DESCRIPTION

Figure 1:
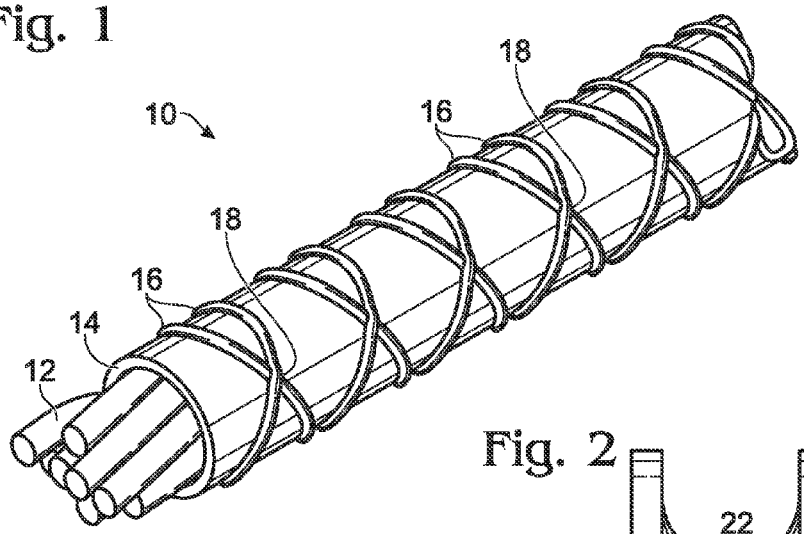
FIG. 1 is a partial sectional view of a drive rope according to an embodiment of the invention.

Referring now to the drawings, wherein like reference numerals refer to like parts throughout, there is seen in FIG. 1 a drive rope 10. Drive rope 10 has a core 12 of high strength fiber or flexible metal cable. Suitable materials for the core 12 include aramid fiber, steel or other equivalent materials known to those of ordinary skill in the art. Core 12 may comprise multiple braided or twisted elements. Core 12 also may be comprised of plastic or polymer material that has been mixed with non-contiguous linear or fibrous elements to enhance its tensile strength. In the preferred embodiment, core 12 is comprised of ⅜" steel cable. Core 12 is surrounded by jacket 14. The material of jacket 14 may also occupy interstitial spaces within core 12. Jacket 14 is comprised of flexible material, such as polyurethane or another equivalent plastic. Jacket 14 must be sufficiently flexible and elastic that it can wrap around the pulleys of a counterweight rigging system without cracking. In the preferred embodiment, jacket 14 is comprised of a 3/16" layer of polyurethane. Drive rope 10 also includes traction elements on its outer surface consisting primarily of features 16 molded into or bonded onto jacket 14. The features 16 preferably are positioned in a consistent cross-woven pattern such that crossing points 18 are consistently and evenly spaced along the length of drive rope 10. The preferred embodiment has a nominal outside diameter of ¾", which makes it suitable for use with standard headblocks used in counterweight rigging systems. According to one embodiment, features 16 are raised above the surface of jacket 14. Alternatively, features 16 may be depressed below the surface of jacket 14.

Figure 2:
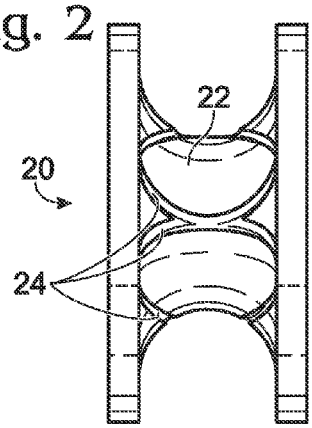
FIG. 2 is an elevation view of a drive pulley corresponding to the drive rope of FIG. 1.

There is shown in FIG. 2 a drive pulley 20. Drive pulley 20 is in many respects a conventional pulley that can be operatively connected to a drive motor (not shown) to transmit the drive motor's rotary motion to a drive rope such as the one depicted in FIG. 1. Around its perimeter, pulley 20 includes a U-shaped groove 22. U-shaped groove 22 includes in its surface a plurality of traction grooves 24. Traction grooves 24 are sized and positioned to match the pattern formed by features 16 of drive rope 10. In this way, features 16 engage traction grooves 24 to increase the traction between drive pulley 20 and drive rope 10. In an alternate embodiment, traction grooves 24 can consist of raised features that correspond to features 16 that are depressed into the surface of jacket 14.

Figure 3:
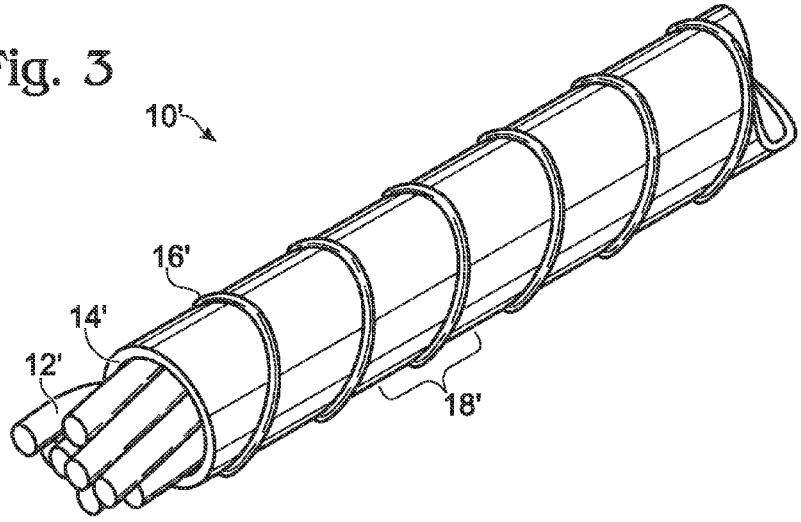
FIG. 3 is a partial sectional view of a drive rope according to another embodiment of the invention.

There is shown in FIG. 3 another embodiment of the invention, consisting of drive rope 10' having a core 12' of high strength synthetic or natural fiber, steel or similar material. Core 12' is surrounded by jacket 14'. Jacket 14' is comprised of flexible material, such as polyurethane or another equivalent plastic. Jacket 14' must be sufficiently flexible and elastic that it can wrap around the pulleys of a counterweight rigging system without cracking. Drive rope 10' also includes traction elements on its outer surface consisting primarily of a spiral-wrapped feature 16' molded on or bonded onto jacket 14'. The spiral-wrapped feature 16' is positioned in a consistent, regular spiral pattern such that each wrap (or thread) 18' is consistently and evenly spaced along the length of drive rope 10'.

Figure 4:
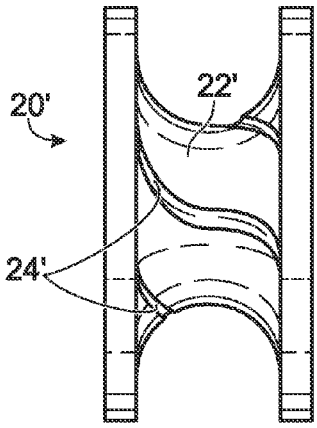
FIG. 4 is an elevation view of a drive pulley corresponding to the drive rope of FIG. 3.

There is shown in FIG. 4 a drive pulley 20'. Drive pulley 20' is in many respects a conventional pulley that can be operatively connected to a drive motor (not shown) to transmit the drive motor's rotary motion to a drive rope such as the one depicted in FIG. 3. Around its perimeter, pulley 20' includes a U-shaped groove 22'. U-shaped groove 22' includes in its surface a plurality of traction grooves 24'. Traction grooves 24' are sized and positioned to match the pattern formed by spiral-wrapped cord 16' of drive rope 10'. In this way, spiral-wrapped cord 16' engages traction grooves 24' to increase the traction between drive pulley 20' and drive rope 10'.

Figure 5:
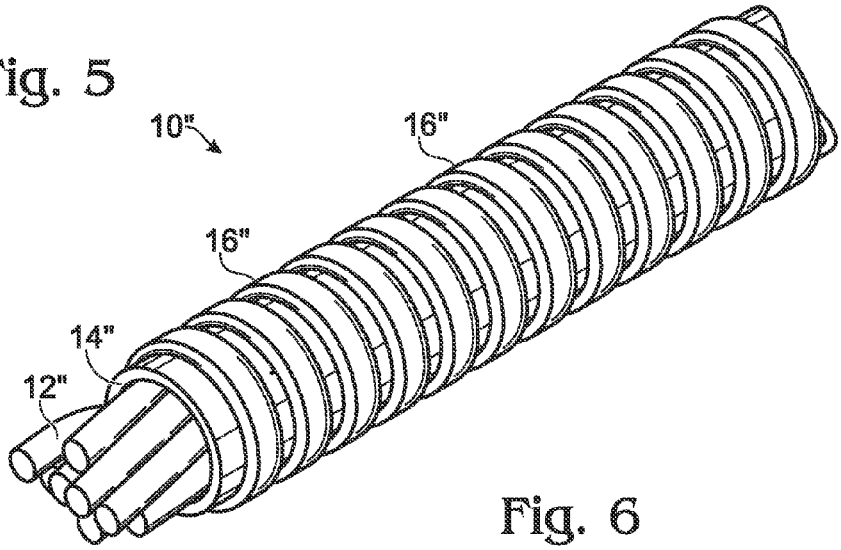
FIG. 5 is a partial sectional view of a drive rope according to another embodiment of the invention.

There is shown in FIG. 5 another embodiment of the invention, consisting of drive rope 10" having a core 12" of high strength s synthetic or natural fiber, steel or similar material. Core 12" is surrounded by jacket 14". Jacket 14" is comprised of flexible material, such as polyurethane or another equivalent plastic. Jacket 14" must be sufficiently flexible and elastic that it can wrap around the pulleys of a counterweight rigging system without cracking. Drive rope 10" also includes traction elements on its outer surface consisting primarily of ridges 16" formed in the surface of jacket 14". Ridges 16" can be formed by adding material to jacket 14" to form each ridge 16", or by molding depressions into the surface of jacket 14" such that a ridge 16" is formed on either side of the depressions. Ridges 16" are positioned in a consistent, regular pattern such that each ridge 16" is consistently and evenly spaced along the length of drive rope 10". According to this embodiment, the outer diameter of ridges 16" is approximately ¾" in diameter to match the size of the drive rope conventionally used in a counterweight rigging system. If a particular counterweight rigging system is designed to operate with rope of a different size, it is readily recognized that drive rope 10" can be fashioned in a variety of sizes.

Figure 6:
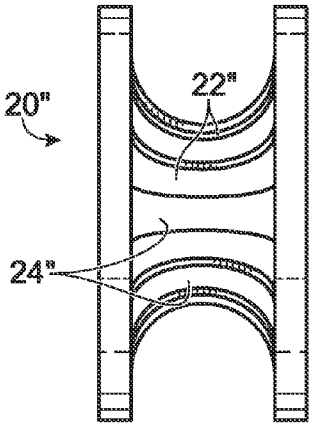
FIG. 6 is an elevation view of a drive pulley corresponding to the drive rope of FIG. 5.

There is shown in FIG. 6 a drive pulley 20". Drive pulley 20" is in many respects a conventional pulley that can be operatively connected to a drive motor (not shown) to transmit the drive motor's rotary motion to a drive rope such as the one depicted in FIG. 5. Around its perimeter, pulley 20" includes a U-shaped groove 22". U-shaped groove 22" includes in its surface a plurality of traction grooves 24". U-shaped groove 22" is sized to accept drive rope 10". Traction grooves 24" are sized and positioned to match the pattern formed by ridges 16" of drive rope 10". In this way, ridges 16" engage traction grooves 24" to provide positive traction between drive pulley 20" and drive rope 10".

Traction features 16, 16' and 16" can be used to index the drive line position of drive rope 10, 10', 10". The positive traction between the drive pulleys and drive ropes of the present invention eliminates slippage between drive rope and drive pulley; each turn of a drive pulley results in linear movement of the drive rope for a distance of $\pi D$ (where D is the pitch diameter of the drive pulley). Because of the positive traction, systems used to control the position of a load suspended from the rigging system can be calibrated to calculate the vertical position of the load based on rotation of the drive pulley.

What is claimed is:

1. A drive rope for use in a theatrical rigging system, the drive rope comprising:

a linear core of flexible material;

a flexible jacket surrounding said core; and a plurality of traction elements formed in said plastic jacket;

wherein said traction elements include a first linear feature and a second linear feature, each of said first and second linear features being wound helically and evenly around said core in opposing directions to form a plurality of equally-spaced crossing points on said drive rope.

2. A drive rope for use in a theatrical rigging system, the belt drive rope comprising:

a linear core of flexible material;

a flexible jacket surrounding said core; and a plurality of traction elements formed in said plastic jacket;

wherein said traction elements include a series of equally-spaced ridges on said drive rope, perpendicular to the linear axis of said drive rope.

3. A drive pulley for use in a power assisted counterweight rigging system, the pulley having a U-shaped groove proximate its perimeter, for receiving a drive rope with traction elements formed on its surface, said U-shaped groove comprising a plurality of traction elements corresponding to the traction elements of the drive rope;

wherein the traction elements of the U-shaped groove include a plurality of X-shaped features for engaging X-shaped traction elements on said drive rope.

4. A drive system for a theatrical rigging system, said system comprising:

a drive rope having;

a flexible linear core;

a flexible jacket surrounding said core; and a plurality of traction elements formed in said flexible jacket; and a drive pulley having a U-shaped groove for engaging and moving said drive rope, said U-shaped groove comprising a plurality of traction elements corresponding to the traction elements of said drive rope;

wherein the traction elements of the drive rope and the traction elements of the pulley are sized and shaped to match patterns so there is no slippage and each turn of the pulley results in linear motion of the drive rope for a distance of $\pi$ times a diameter of the drive pulley.

* * * * *